US007803093B2

(12) United States Patent
Koelbel

(10) Patent No.: US 7,803,093 B2
(45) Date of Patent: Sep. 28, 2010

(54) FREELY MOVEABLE STRENGTH TRAINING DEVICE FOR STRENGTHENING THE BODY MUSCULATURE, WHICH CAN BE LOADED BY PULLING

(76) Inventor: Gert F. Koelbel, Wietze-Aue 34, 30900 Wedemark (DE)

( * ) Notice: Subject to any disclaimer, the term of this patent is extended or adjusted under 35 U.S.C. 154(b) by 0 days.

(21) Appl. No.: 12/286,578

(22) Filed: Oct. 1, 2008

(65) Prior Publication Data

US 2009/0093351 A1 Apr. 9, 2009

(30) Foreign Application Priority Data

Oct. 4, 2007 (DE) ..... 20 2007 013 860 U

(51) Int. Cl.
*A63B 21/02* (2006.01)

(52) U.S. Cl. ..... 482/126; 482/122

(58) Field of Classification Search ..... 482/121–128, 482/133–138
See application file for complete search history.

(56) References Cited

U.S. PATENT DOCUMENTS 1,585,748 A * 5/1926 Wendelken ..... 482/143
4,149,715 A * 4/1979 Kusmer ..... 482/128
4,376,533 A * 3/1983 Kolbel ..... 482/125
4,384,715 A * 5/1983 Savio et al. ..... 482/128
4,685,670 A * 8/1987 Zinkin ..... 482/129
4,725,057 A * 2/1988 Shifferaw ..... 482/130
5,005,832 A * 4/1991 Van Der Hoeven ..... 482/124
6,063,013 A * 5/2000 Vathappallil ..... 482/121
6,123,652 A * 9/2000 Perleberg-Kolbel ..... 482/126
6,413,196 B1 * 7/2002 Crowson ..... 482/118
6,659,922 B1 * 12/2003 Yu ..... 482/127
2004/0198571 A1 * 10/2004 Howell et al. ..... 482/123
2006/0040806 A1 * 2/2006 Chen ..... 482/124
2007/0015638 A1 * 1/2007 Wu ..... 482/121

FOREIGN PATENT DOCUMENTS

DE 197 11 835 9/1998

* cited by examiner

*Primary Examiner*—Fenn C Mathew
(74) *Attorney, Agent, or Firm*—Collard & Roe, P.C.

(57) ABSTRACT

A freely movable strength training device for strengthening the body musculature can be loaded by pulling. The device has a housing and at least one spring element arranged in the housing, which can be loaded via muscular strength. The device has at least two pull elements which can be actuated by a user. All pull elements are fastened on the spring element.

12 Claims, 4 Drawing Sheets

Figure 1:
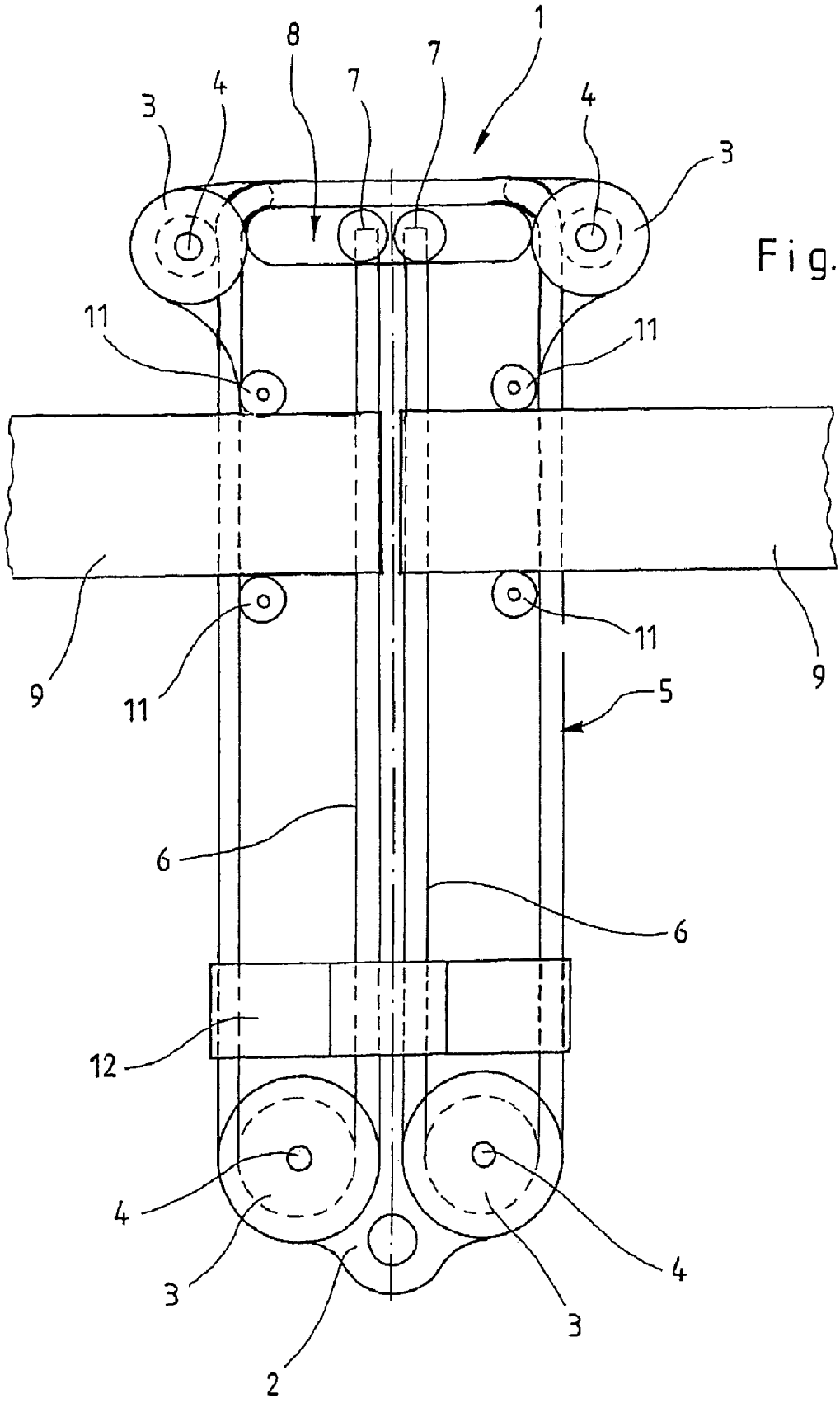

FREELY MOVEABLE STRENGTH TRAINING DEVICE FOR STRENGTHENING THE BODY MUSCULATURE, WHICH CAN BE LOADED BY PULLING

CROSS REFERENCE TO RELATED APPLICATIONS

Applicant claims priority under 35 U.S.C. §119 of German Application No. 20 2007 013 860.1 filed on Oct. 4, 2007.

The invention relates to a freely moveable strength training device for strengthening the body musculature, which can be loaded by pulling and which has a housing and at least one spring element arranged in the housing, which can be loaded by means of muscular strength.

Strength training devices are used for the body fitness of their users. The spring element can be acted upon by using the strength of various muscle groups, in order to load and, as a result, train the latter. In addition to immobile strength training devices e.g. in fitness studios, freely moveable, that is to say mobile strength training devices are known.

A mobile strength training device according to the generic type specified above is described in DE 197 11 835 C2. This strength training device has pull loops, of which one acts on a spring element and the other is attached to the housing. Strength training is thereby enabled. However, the problem arises in this case that a pull bar, which is guided against a displaceable spring clip which produces the desired resistance, and which also bears the moveable pull loops, assumes too steep an inclination in the event of larger effort from the person training, so that the spring clip seeks the path of least resistance and undesirably springs back to the initial position in the middle of training.

The object of the invention is to show a training device of the generic type mentioned at the beginning, which allows handling which is uncomplicated and safe for training.

This object is achieved according to the invention by a strength training device with the features of claim 1. Advantageous developments and configurations of the invention are given in claims 2 to 12.

In the case of a freely moveable strength training device for strengthening the body musculature, which can be loaded by pulling and which has a housing and at least one spring element arranged in the housing, which can be loaded by means of muscular strength, it is provided according to the invention that the strength training device has at least two pull elements which can be actuated by a user, wherein all pull elements are fastened on the spring element.

In the case of the strength training device according to the invention, no pull element is fastened directly on the housing of the strength training device. All pull elements are guided as far as the spring element, so that the forces from the pull elements are applied directly onto the spring element. In this case, an arrangement of the pull elements is possible in such a manner that a linear opposing application of forces into the spring element takes place so that the latter is held securely between the pull elements and without the occurrence of transverse forces. The direct fastening of at least two pull elements to the spring element advantageously divides the spring travel. Simple handling of the strength training device is additionally advantageously guaranteed.

According to a first development of the invention, it is provided that the housing is formed from plate elements orientated parallel to one another. The housing therefore has a simple configuration. Two plates can be provided, which are arranged spaced apart from one another. An installation space is then formed between the two plates, in which the spring element can be arranged. The pull elements can be inserted laterally into this open housing and brought into a holding connection with the spring element. In accordance with this development, the strength training device shows an open configuration in a sandwich construction, which also foregoes the use of plastic parts completely, in order, in the clinical rehabilitation sector, to also enable disinfection of the inside of the device in an autoclave. Stamina training with a device that is passed to the next sick person which training serves faster recovery thereby becomes possible in a hospital bed without having to fear a possible contamination of the device by means of previous use by another person. Because such an internal and external disinfection is also required in the manned space flight sector, the suitability of the invention for body training to counteract astronauts' isolation from gravity, which causes bone and muscle wastage, is shown for this reason and also due to the low dead weight as well as due to the multifaceted training.

The spring element can in this case be a rod component which is inserted e.g. in several windings between the two plate elements. The spring element is then fixed between the plate elements in certain sections, other sections of the spring element remain moveable for absorbing and outputting forces. The preferred configuration of the spring element in which it is made from a round material ensures a near wear-free accommodation of the pull elements.

The sections which absorb forces are, according to a development at least two sections of the spring element which run approximately parallel to one another and on which the pull elements are fastened. One pull element is for example arranged on each section, with which pull element a force can be exerted on this section. If two pull elements are provided for two sections, then for example both arms of the user or also both feet of the user can be provided for introducing forces.

For a successful handling of the strength training device according to the invention, a development of the invention provides that the free ends of the sections of the spring element which run parallel to one another are arranged in an inspection window of the housing. The free ends of the spring element can be seen in the inspection windows. Their deflection by means of a sustained pull on the moveable sections of the free spring ends can be discerned for the user on both sides of the device, thus also when checking the movement patterns in a mirror, or for a trainer standing in front of the person exercising, and can be exploited for the training. The travel markings on the housing for the free spring ends, which can be read off in the region of the inspection window, give information about whether the pull force is maintained decreasingly, evenly or without it being a challenge. The person training can interpret this themselves or by means of a trainer as the resistance having been set too high, correctly, or too low, and, if necessary, correct it in accordance with the next development.

Furthermore, it is provided that, in each case, a force indicator is arranged at the free ends of the moveable sections of the spring element. An advantageously simple check on the pull force supplied in the region of the inspection window which has the travel markings is always ensured with the aid of the force indicator which is preferably of spherical design. The correct, excessive or inadequate training efforts of a person using the training device can therefore be determined by means of the position of the force indicator. The spherical force indicators which are, for example, put onto the free ends are prevented from coming off of their own accord, in particular, by means of the arcs of the spring element which are guided over them.

For further constructive configuration of the strength training device according to the invention, a development of the invention provides that the sections which run parallel to one another originate from deflection points for the spring element, which are arranged in a line, and that a displacement part which changes the lever arm on the moveable sections for the pull elements which act thereon is pushed onto the sections. The pull elements are fastened on the sections which run parallel to one another. With the introduction of forces, the parallel sections can then be pulled out of their parallelity and pulled away from one another. If the force action is reduced, then the section springs back to the parallel position once more.

The regions of the sections which move out of position can extend from the free ends in the inspection window to the deflection points provided. In this case, a deflection of the sections is enabled with a relatively small force. The length of the regions of the sections which can be moved out of place is limited by means of the displacement piece which is provided according to the invention. The displacement piece namely fixes the distance between the sections in the region of the arrangement of the displacement part. If this is therefore pushed from the deflection points for the spring element in the direction of the free ends of the spring elements, then the region of the sections which can still be deflected by applying force becomes smaller. The lever effect is reduced and a larger force is to be applied by means of the pull elements for the displacement of the sections out of their parallel position. So, by means of the displacement part, an increase in the forces to be applied for a certain design can be achieved. Only two moveable built-in components are still present in the interior of the housing with the spring element and the displacement part, as a result, the robustness of the strength training device is increased. The open construction of the housing makes a thorough cleaning possible, both for normal household usage and usage when travelling or following usage on the beach with soiling by sand, sun tan lotion, sea water, etc., by means of simply placing it into a dishwasher and the latter's cleaning procedure. Owing to its compact design, any form of movement and force development of both isokinetic and isometric type is possible between two hands or two feet with the strength training device loaded with a sustained pull. This is true both for short movements in the region of up to 70 cm and/or for forms of movement of up to 2.30 meters, which can be carried out, for example, with hands raised high above the head as far as the region of the feet with constant resistance accompaniment of the device, and in this manner include many further muscles and muscle groups in the training.

It lies furthermore within the framework of the invention that the spring element is configured as a guide for the displacement part which encompasses predetermined regions of the spring element when considered in the longitudinal direction of the latter. Particularly the middle regions of the spring element form guide rail sections for the displacement part which is preferably configured in a clasp-shaped manner, wherein at the same time a self locking friction-tight connection is advantageously given between the displacement part and the spring element which serves as a guide In addition to the change of the pull resistance on the moveable leg sections of the spring element in the weight range of between 0.5 and 90 kg, an advantageous securing of the displacement part on the spring element therefore takes place. The self-securing is increased during a pull loading in that the sections of the spring element, which run parallel to the outside edge of the training device in each case, by means of a pull loading cause the spring element's inner sections, which are held moveably, to bulge outwards and therefore effect a strengthened clamping of the clasp-shaped displacement part. Furthermore, owing to the sections of the spring element, which likewise consist of round material and are guided parallel to the outside edge of the housing, the wear on the pull elements which are guided past them is reduced to a minimum, even if the pull elements must be pulled at an angle to the training device for certain forms of exercise.

The scale of the settable resistance to be given is available for pure fitness exercises in the region of 0.5 to 40 kg. Athletic strength training with sporting contour changes on the body are possible in the settable region between 40 and 90 kg. Even higher resistance values can also be achieved by replacing the built-in spring. The production, the sandwich construction and the shaping of the components are selected and designed so that they are not burdened with the costs for expensive moulds and tools. For the most part, the components are produced by laser cutting. It is in this manner that high-quality and sturdy material can be offered on the market and a 20 year durability guarantee be offered therefor, without considerable costs for moulds and tools and the replacement thereof due to wear needing to be included in the calculation. The laser cutting technology additionally allows immediate changes to be made to the design at any time without any costs, maintenance and re-equipping times whatsoever.

The pull elements are guided laterally out of the housing. Preferably, guide elements are provided for this purpose, which are e.g. in each case configured as a roller.

A double pull loop on each side of the device preferably comprises a hand loop and a foot loop, so that for the hands and the feet, but also for operating the device using wrists and ankles, the same loops are not to be used. The hand loops are smaller in size so that for exercises with crossed wrists, the hands are allowed as close as possible to the device and so no part of the path of movement is given up for this type of exercise.

Each hand and foot loop can, in this case be formed from a one piece strap which is, in sections, laid in layers which are on top of one another, and in which stitches are inserted to form the hand and foot insertion points. This enables an efficient production of the loops.

Figure 2:
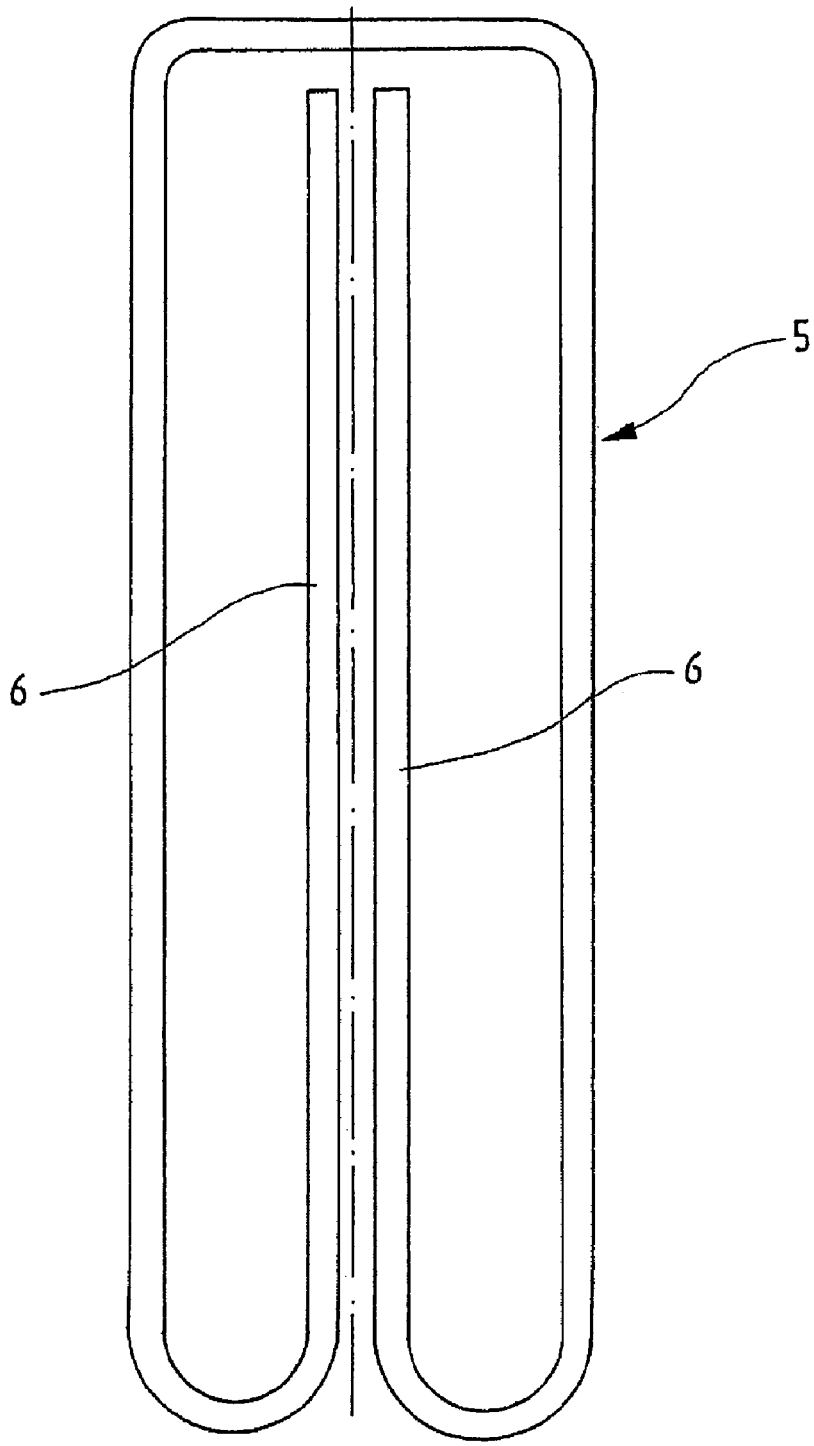
Figure 3:
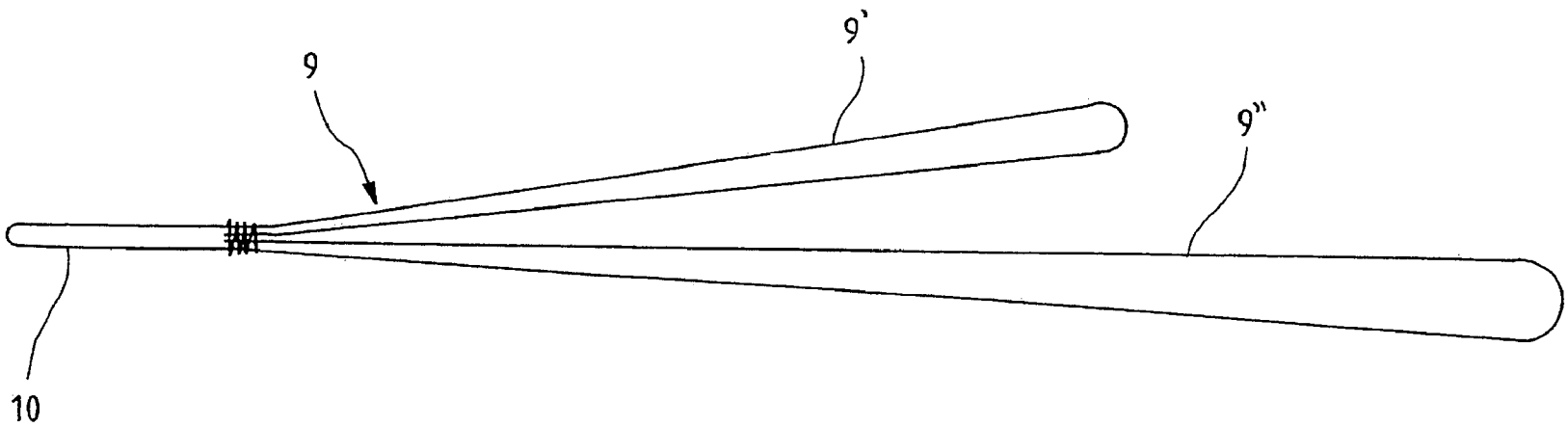
Figure 4:
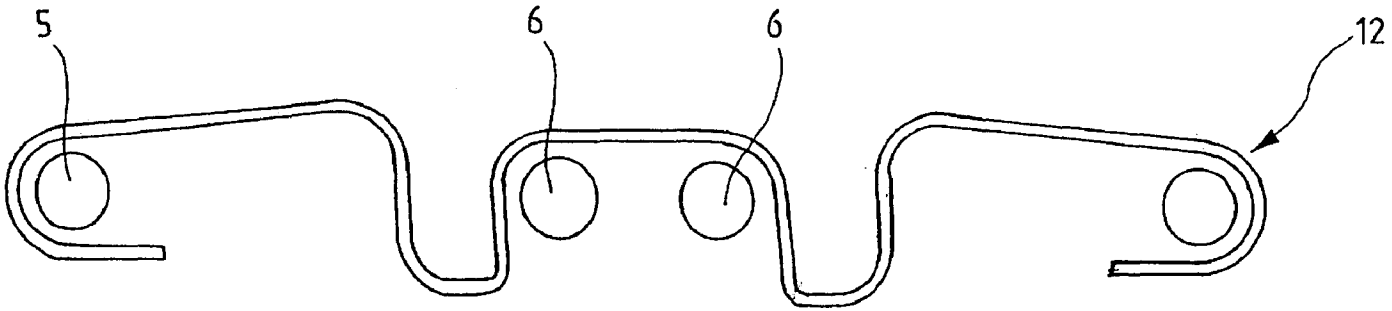
Figure 5:
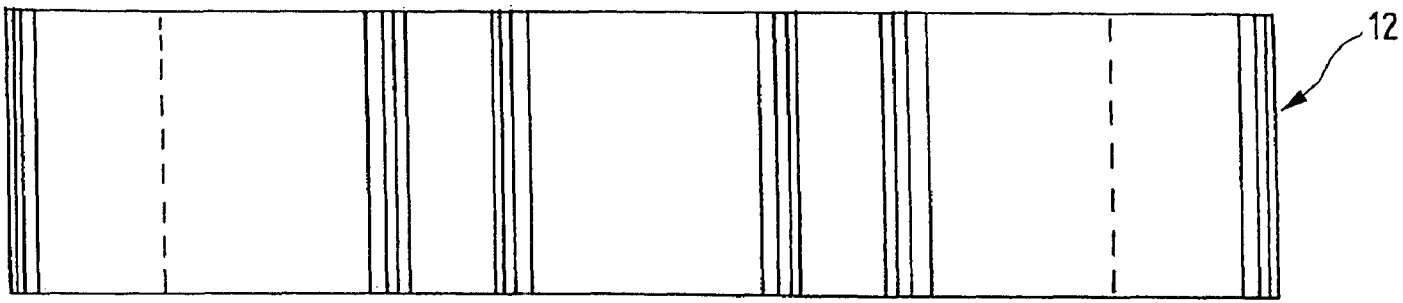

An exemplary embodiment, from which further inventive features result, is illustrated in the drawing. In the figures:

FIG. 1 shows a plan view of a strength training device for strengthening the body musculature according to the invention, FIG. 2 shows a side view of the spring element of the strength training device according to FIG. 1, FIG. 3 shows a side view of a pull element for the strength training device according to FIG. 1, and FIG. 4 and FIG. 5: show side and plan views respectively of a component of the strength training device according to FIG. 1.

The strength training device in FIG. 1 has a housing 1. The housing 1 formed from two plate elements 2 which are orientated parallel to one another. Roller bodies 3 are inserted between the two plate elements 2, the pins 4 which bear the roller bodies 3 additionally connect the two plate elements 2.

A spring element 5 is inserted between the plate elements 2. This spring element 5 is also shown in FIG. 2, it is made out of spring steel and bent in the manner of a clip. The diameter of the spring steel is e.g. 4 mm, the spring preferably has the spring class C and consists of hardened high-grade steel.

In the housing 1, the spring element 5 is fixed with the roller bodies 3. Inner sections 6 of the spring element 5 run parallel to one another starting from roller bodies 3 which are arranged in a line. The free ends 7 of these sections 6 are arranged in an inspection window 8 of the housing 1. Spherical caps are placed on the free ends 7 for better discernibility.

The pull elements are configured as pull loops 9. FIG. 3 shows that a pull loop of this type has two loop sections, namely a hand loop 9' and a foot loop 9". The pull loop 9 is attached to the section 6 of the spring element 5 with the section 10 of the pull loop. Guide elements 11 also serve the guiding of the pull loops 9 in the housing 1.

A displacement part 12 is also assigned to the sections 6 of the spring element 5 inside the housing 1. This displacement part 12 can be displaced on the sections 6 parallel to the longitudinal axis of the housing 1. The length of the sections 6 which can be deflected with the pull loops 9 is thus reduced, as these sections 6 are fixed in a manner in which they cannot change length with respect to one another in the region between the roller bodies 3 which are arranged on a line and the displacement part 12.

The displacement part 12 is shown in FIGS. 4 and 5. It accommodates the various sections 6 of the spring element 5 within itself, and consists in the process of a one-piece wall spring made of spring steel. The material thickness is e.g. 0.8 mm, the width 15 mm.

The plate elements 2 of the housing 1 can be cut out e.g. with a laser, as a result, they can be produced very precisely. High-grade steel can again be selected as material, so that an impression of high quality is created.

The invention claimed is:

1. A freely moveable strength training device, for strengthening a body musculature, comprising a housing, at least one spring element arranged in the housing, and at least two pull elements;

wherein the freely moveable strength training device can be loaded by pulling;

wherein the at least one spring element can be loaded by means of muscular strength;

wherein the at least two pull elements can be actuated by a user;

wherein the at least two pull elements are fastened on the at least one spring element;

wherein the at least one spring element has at least two sections running approximately parallel to one another;

wherein the at least two pull elements are fastened on the at least two sections running approximately parallel to one another of the at least one spring element; and wherein free ends of the at least two sections running approximately parallel to one another of the at least one spring element are arranged in an inspection window of the housing.

2. The freely moveable strength training device according to claim 1, wherein the housing is formed from a first plate element and a second plate element orientated parallel to one another.

3. The freely moveable strength training device according to claim 2, wherein the at least one spring element is a rod component inserted between the first plate element and the second plate element.

4. The freely moveable strength training device according to claim 1, wherein travel markings for a deflection of the free ends of the at least two sections running approximately parallel to one another of the at least one spring element are applied to the housing in a region of the inspection window.

5. The freely moveable strength training device according to claim 1, wherein a force indicator is arranged at the free ends of the at least two sections running approximately parallel to one another of the at least one spring element.

6. The freely moveable strength training device according to claim 1, wherein the at least one spring element is configured as a guide for a displacement part; and wherein the displacement part encompasses predetermined regions of the at least one spring element.

7. The freely moveable strength training device according to claim 1, wherein guide elements for the at least two pull elements are arranged in the housing.

8. The freely moveable strength training device according to claim 7, wherein each guide element is configured as a roller.

9. The freely moveable strength training device according to claim 1, wherein each pull element of the at least two pull elements comprises a double pull loop.

10. The freely moveable strength training device according to claim 9, wherein each double pull loop comprises a hand loop for actuation with a hand and comprises a foot loop for actuation with a foot.

11. The freely moveable strength training device according to claim 10, wherein each double pull loop is formed from a one piece strap;

wherein each one piece strap is, in sections, laid in layers;

wherein the layers are on top of one another; and wherein stitches are inserted into each one piece strap to form hand and foot insertion points.

12. A freely moveable strength training device, for strengthening a body musculature, comprising a housing, at least one spring element arranged in the housing, at least two pull elements, a displacement part, and a lever arm;

wherein the freely moveable strength training device can be loaded by pulling;

wherein the at least one spring element can be loaded by means of muscular strength;

wherein the at least two pull elements can be actuated by a user;

wherein the at least two pull elements are fastened on the at least one spring element;

wherein the at least one spring element has at least two sections running approximately parallel to one another;

wherein the at least two pull elements are fastened on the at least two sections running approximately parallel to one another of the at least one spring element;

wherein the at least two sections running approximately parallel to one another of the at least one spring element originate from deflection points for the spring element;

wherein the deflection points for the at least one spring element are arranged in a line;

wherein the displacement part is pushed onto the at least two sections running approximately parallel to one another of the at least one spring element; and wherein the displacement part changes the lever arm on the at least two sections running approximately parallel to one another of the at least one spring element.

* * * * *